United States Patent [19]

Clark

[11] 3,933,067

[45] Jan. 20, 1976

[54] CUTTER DEVICE FOR CUTTING THERMOPLASTIC MATERIAL

[76] Inventor: Julius Clark, 224 W. Freeport, Broken Arrow, Okla. 74012

[22] Filed: Sept. 24, 1974

[21] Appl. No.: 508,905

[52] U.S. Cl. ..... 83/155; 83/401; 83/408; 83/437; 83/578; 83/928

[51] Int. Cl.[2] ..... B26D 7/06

[58] Field of Search ..... 83/401, 408, 437, 578, 83/928, 155; 144/3 D

[56] References Cited

UNITED STATES PATENTS

| | | | |
|---|---|---|---|
| 1,592,656 | 7/1926 | Corona | 144/3 D |
| 1,771,496 | 7/1930 | Leguillon | 83/437 X |
| 2,723,443 | 11/1955 | McKibben | 83/401 |
| 3,180,195 | 4/1965 | Clark | 83/408 |
| 3,334,533 | 8/1967 | Davis | 83/578 |
| 3,414,027 | 12/1968 | Larva et al. | 83/928 X |

*Primary Examiner*—Donald R. Schran
*Attorney, Agent, or Firm*—Young & Thompson

[57] ABSTRACT

A cutter device for cutting thermoplastic material may be truck mounted, and includes lifting means to present articles of thermoplastic material to a portion of the device which receives the articles and hydraulically operates to transfer the article to the cylindrical portion of the device along which the article is pushed toward one end of the device where a hydraulically operated knife can selectively cut off portions of the thermoplastic material as desired. The device also includes conveyor means to transfer the cut off portions of thermoplastic materials away from the cutter device to an area where they are intended to be used. The conveyor means are hydraulically operable from the same source of hydraulic pressure as operates the other components of this device.

2 Claims, 7 Drawing Figures

INVENTOR.
JULIUS CLARK

BY

Robert E. Mazer

ATTORNEY

INVENTOR.
JULIUS CLARK

Robert C. Moore
ATTORNEY

INVENTOR.
JULIUS CLARK

BY

Robert C. Mace

ATTORNEY

INVENTOR.
JULIUS CLARK

BY Robert C. Wason

ATTORNEY

INVENTOR.
JULIUS CLARK

BY Robert C. Mace

ATTORNEY

CUTTER DEVICE FOR CUTTING THERMOPLASTIC MATERIAL

BACKGROUND OF THE INVENTION

I have invented a somewhat similar cutter device for thermoplastic material which is described in U.S. Pat. No. 3,180,195, issued Apr. 27, 1965. However, the cutter device of this instant application differs in considerable detail from the device described in the prior patent. For example, one important distinction is the manner in which guide means for the knife blade are arranged in this device to more efficiently, more accurately, and more controllably direct the movement of the knife blade than was provided by the knife blade guide means of my prior patent. I found that the guide means employed in my prior patent occasionally had a tendency to bind because of the geometric arrangement of the guide means in relation to the body frame and knife blade of the cutting device. In this application I have disposed the guide means for the knife blade in a manner that a flat side of the guide means moves slidably against a substantial flat side of the body frame thus eliminating the tendency to bind. By "binding," I mean that the knife blade would become canted in its movement down the frame and have a tendency to become stuck so that further easy movement was difficult. The present guide means causes the knife blade to remain in the same proper horizontal disposition during its downward and upward movement in the frame. Another distinction that I have made in this present invention is to provide a double edged knife blade, whereas the prior patent concerned only a single edged blade which was effective only in the downward cutting movement. The present blade provides a cutting motion both downward and upward.

Another important distinction I have made in the present invention compared to my prior patent is to provide a simpler and more efficient means of pushing the thermoplastic article along the support frame of the device. In the prior patent I positioned a horizontal piston rod and cylinder on each side of the frame to move the reciprocable plunger horizontally along the cylindrical chamber of the device. I have found that the device is simpler and more efficient in operation by providing a single piston rod and cylinder behind the plunger member in axial alignment therewith to force the horizontal movement of the reciprocable plunger and consequently the article of thermoplastic material. In addition to the distinctions described above, I have provided numerous other improvements in a cutter device which will be described in detail hereinafter.

The principle object of this invention is to provide a cutter device for thermoplastic materials which is simple in construction, easy and efficient to operate, and inexpensive to manufacture.

Another object of this invention is to provide a cutter device for thermoplastic material which has a high capacity for cutting articles of thermoplastic material into smaller portions, efficiently and quickly and with great ease in handling and moving the thermoplastic material.

Still another object of this invention is to provide means for handling articles of thermoplastic material which are simple in construction, easy to maintain, and easy to operate.

BRIEF DESCRIPTION OF THE DRAWINGS

Further objects and advantages of the invention will become apparent from the following description and claims, and from the accompanying drawings, wherein:

DESCRIPTION OF THE PREFERRED EMBODIMENTS

The present invention relates to apparatus for cutting portions of thermoplastic material.

Various forms of thermoplastic material are employed as coating materials for certain objects, for example, bituminous compositions are used for coating pipelines. However, the bituminous materials are generally solid or semisolid at ambient temperatures and must be heated prior to application to the pipeline in a melted condition. Usually these thermoplastic materials had been melted at the time they were placed in their containers, and since the containers are of thin, easily cut material, it is a simple procedure to cut the thermoplastic material into small portions while it is still in the container. Therefore, this invention comprises a cutter device mounted on a framework, having hydraulically operable movement means which can lift a container of thermoplastic material and present it to support means for the thermoplastic material so that pusher means which is hydraulically reciprocable may urge the container along the support means toward a first end of the support means where cutting means mounted on the frame having a hydraulically operable knife blade mounted in an upstanding frame may cut off portions of the thermoplastic material as it is pushed outwardly beyond an end of the support means. Preferably, the knife blade is a double edged, double acting blade arranged so that the cutting motion is effective both in a downward direction and an upward direction. Then, as the cut portions fall from the thermoplastic material, conveyor means positioned adjacent the first end of the support means will receive and convey the cut portions of thermoplastic material to the remote position where desired. Also preferably, the conveyor means are hydraulically operable by the selective communication of hydraulic fluid with the other operating components of the invention.

Figure 1:
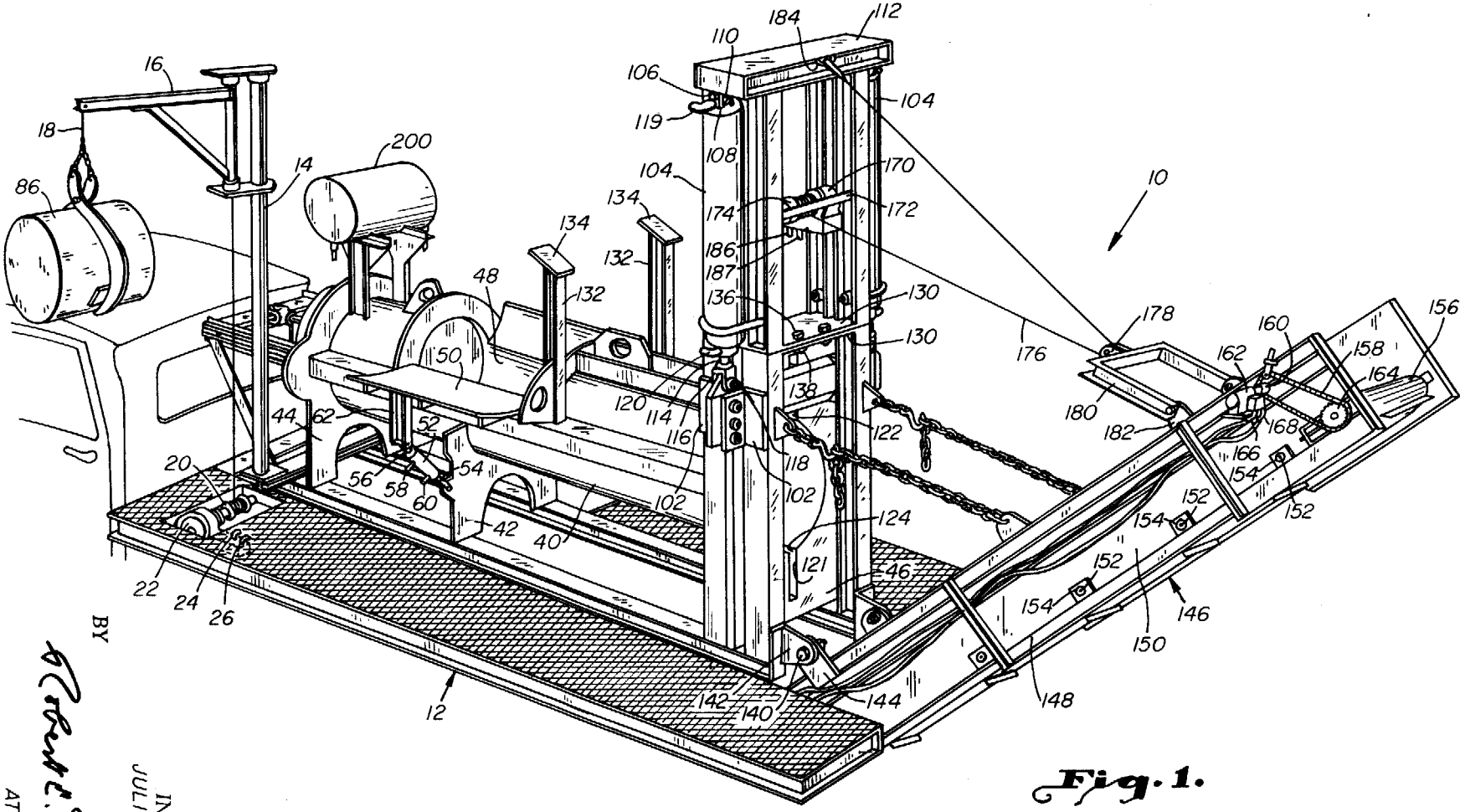
FIG. 1 is a perspective view of a cutter device for thermoplastic materials according to this invention showing components of the device in position to receive a cylindrical article of thermoplastic material.

Referring now to the drawings in detail, FIG. 1 is a perspective view of a cutter device 10, generally, according to this invention as it would be when mounted on a truck body or other prime mover. A frame 12, generally, provides support means for operating components of the cutter device as well as means for supporting the workmen who operate the device. Adjacent one end of the frame is an upright pole member 14 to which is swingably secured a boom 16 having suitable conventional pulleys over which a cable 18 can operate by means of a hydraulic winch 20 powered by a hydraulic motor 22 having an inlet 24 and an outlet 26 for hydraulic fluid. Inlet 24 and outlet 26 are connected by suitable hydraulic lines (not shown) to a source of hydraulic power as described in the schematic diagram of FIG. 7.

Figure 3:
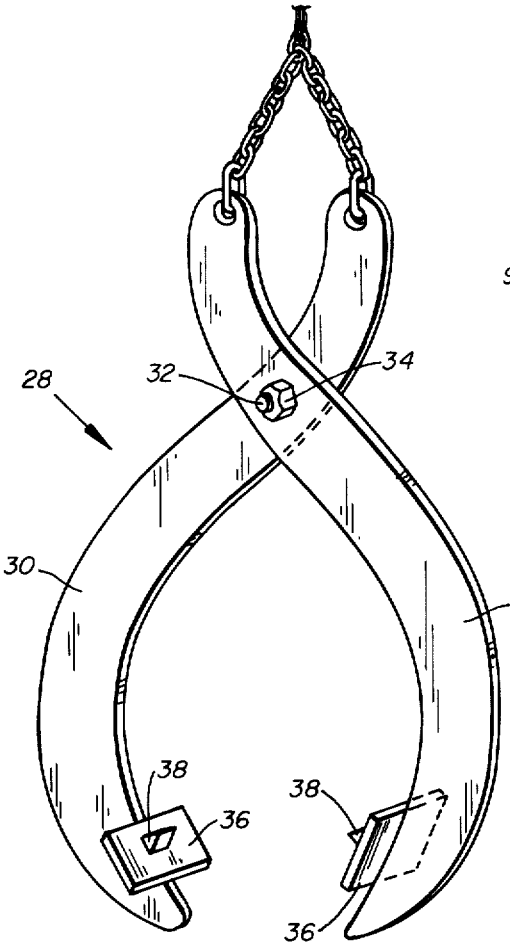
FIG. 3 is a perspective view of a pair of lifting tongs according to this invention designed for efficient lifting of thermoplastic articles.
Figure 4:
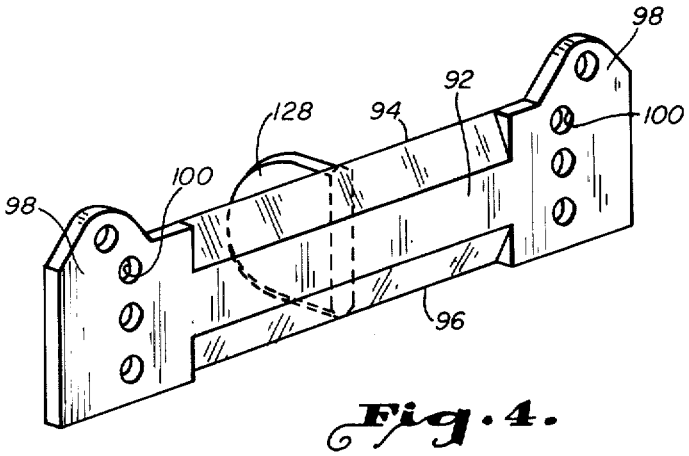
FIG. 4 is a perspective view of a cutting knife for thermoplastic material according to this invention.

I have found that it is of particular advantage and convenience to provide special lifting means for containers of thermoplastic materials for my cutter device as shown by the boom just described and a pair of lifting tongs 28, generally, as described in FIG. 3. Lifting tongs 28 include a pair of identical recurved leg members 30 scissorably attached to each other by proper means as by a bolt 32 and nut 34. Adjacent the end of the tongs which provide the grabbing motion, is a flat container support member 36 secured in position and having thereon a sharp pin member 38 placed in the most suitable position to contact a container of thermoplastic material or a portion of said material when the tongs surround and grab the material.

A cylindrical support member 40 is positioned on the frame as by legs 42, 44, and 46, and includes a cut away portion 48 which is arranged to receive therein a container or article of thermoplastic material. A hydraulically operable lift member 50 is swingably secured to cylindrical support 40 adjacent one edge of support member 40 and cutaway portion 48 so that in operation, an article of thermoplastic material may be transferred from tongs 28 to lift member 50 and then transferred from lift member 50 to the cylindrical interior of support 40 by action of a hydraulic cylinder 52 swingably attached to leg 42 by one end of rod member 54 and pivot member 56. Hydraulic cylinder 52 includes a piston (not shown) and hydraulic connections 58 and 60 connected to suitable hydraulic lines as further described in the schematic view of FIG. 7. Hydraulic cylinder 52 operates against an extension member 62 secured to lift member 50.

Then, with an article of thermoplastic material resting in the cylindrical support member 40, pusher means are actuated to urge the portion of thermoplastic material toward a first end of the said support means. The pusher means includes a reciprocable pusher member 64 which substantially conforms to the cylindrical interior portion of cylindrical support 40 and which is powered reciprocably longitudinally along support 40 by means of a hydraulic cylinder 66 having one end thereof secured to an internal end of pusher member 64 by means of connection 68, which is pinned by pin 70 to member 72, and having a piston rod 74 which operates therein pinned to plate 76 by pin 78 through member 80. Rod 74 has connected to an end thereof within cylinder 66 a piston (not shown) which is acted upon by hydraulic fluid entering cylinder 66 through hydraulic connections 82 and 84 which are also connected to suitable hydraulic lines as shown in the schematic FIG. 7. By this means, hydraulic fluid may enter cylinder 66 under pressure through either connection 82 or 84 and exit by the unpressurized connection so that pusher member 64 may be reciprocably operated.

Figure 2:
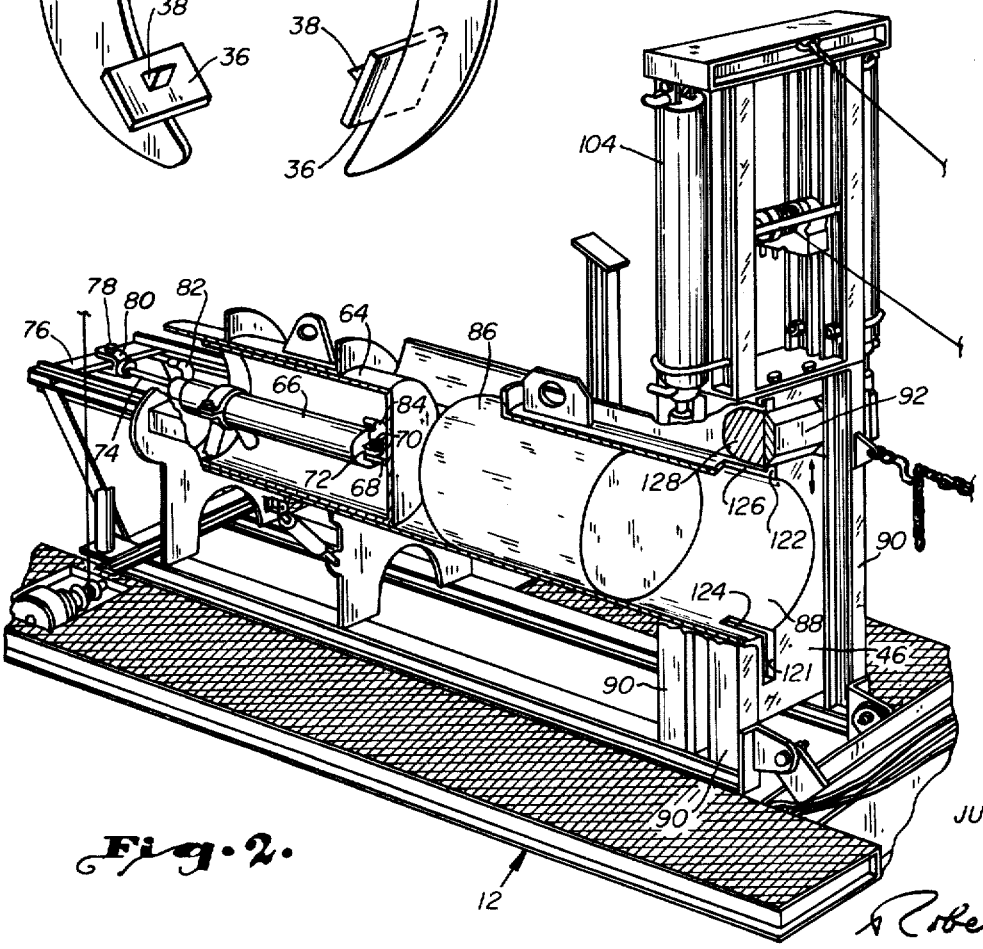
FIG. 2 is a perspective view, partly in section, showing a cutter device for thermoplastic material according to this invention presenting an article of thermoplastic material toward an area of the device where portions of the thermoplastic material may be cut.
Figure 5:
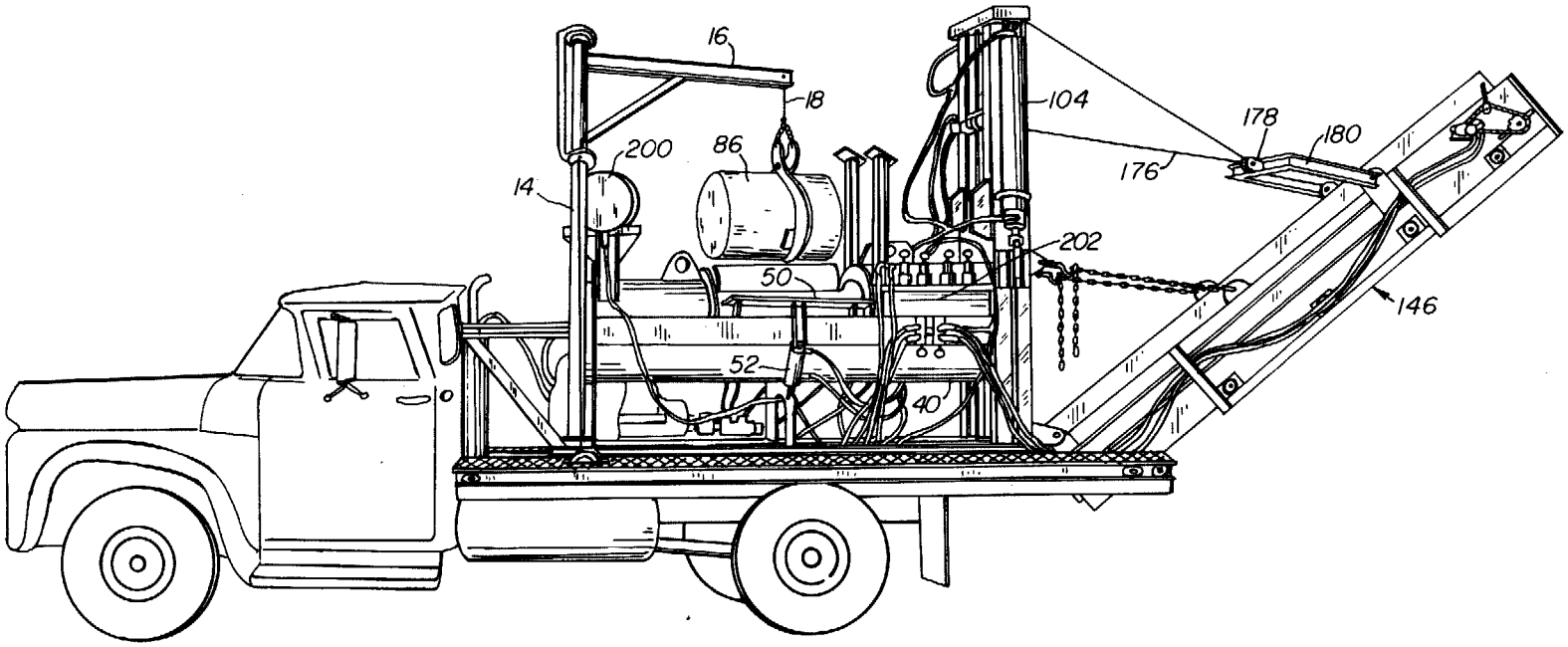
FIG. 5 is a perspective view of a cutter device according to this invention showing the components thereof mounted upon a truck for easy transport.

Pusher member 64 may then push articles of thermoplastic material 86 forward as described in FIG. 2 into a forepart of cylindrical support 40 which is in the form of a complete cylinder in order to provide further support to article 86 during a cutting operation. Adjacent a front end of cylindrical support 40 are upright frame members 90 positioned substantially normal to base frame 12 in a manner to provide support for a cutting means in the manner of a knife blade 92. Knife blade 92 is preferably a double edged, double acting knife blade having cutting edges 94 and 96 to provide cutting means as the blade is moved in either up or down motion. Knife blade 92 includes end plates 98 having openings 100 therein by means of which knife blade 92 may be secured between guiding plates 102 by securing of conventional nuts and bolts through corresponding openings in guiding plates 102. Guiding plates 102 are right angular in shape so that a flat portion of the guiding plate may move slidably and smoothly along a flat outer surface of support frames 90 to provide proper alignment for knife blade 92 to keep the knife blade in substantial horizontal disposition.

Hydraulic means are attached to knife blade 92 to permit the upward and downward force of the knife blade. Such hydraulic means are in the form of a hydraulic cylinder 104 secured at one end by pin 106 passing through member 108 of the hydraulic cylinder and member 110 secured to upper frame 112 connecting frames 90. Hydraulic cylinder 104 includes a piston therein (not shown) secured to a rod 114 further attached to members 116 and pinned to guiding plate 102 by pin 118. Cylinder 104 further includes hydraulic connections 119 and 120 which are in communication with the general hydraulic system as shown in the schematic view of FIG. 7, and which permit the entrance and exit of pressurized hydraulic fluid to control the movement of knife blades 92.

Knife blade 92 moves slidably adjacent and in close alignment with support leg 46 which has a flat surface substantially normal to the longitudinal axis of cylindrical support 40 so that as a portion of thermoplastic material is pushed beyond the edge of support 40 a surface is provided against which knife blade 92 may slide to cut off a portion of the thermoplastic material. Support leg 46 has a slot 121 in its lower section and a slot 122 in its upper section which are contiguous with slots 124 and 126 in cylindrical support 40 all of which are in alignment with and provide means for passage of a central knife blade 128 disposed centrally at substantial right angle to knife blade 92. Central knife blade 128 is approximately semi-circular in conformation and provides a vertical cut in the article of thermoplastic material during operation of knife blade 92 in either the downward or upward motion.

As shown in FIGS. 1 and 2, support frame 90 may be hinged across its central portion and may have plates 130 attached to the separate members of support frane 90 to provide additional support therefor and to provide means for attachment of suitable hinges (not shown) by means of which the upper portion of support frame 90 may be lowered to rest on upstanding member 132 each having plates 134 thereon to support the upper portion of support frame 90. When support frame 90 is in the upstanding position as shown FIGS. 1 and 2, which is its operating mode, plates 130 are held together by suitable machine bolts 136 and nuts 138 attachable thereto.

Secured pivotally adjacent support frame 90 and the end of cylindrical support 40 by means of suitable pin 140 through entension members 142 and 144 is a hydraulically operable conveyor 146, generally, which includes a lower frame 148 and side frames 150 with conveyor rollers (not shown) positioned bearably inside frames 150 as by means of shafts 152 positioned in bearings 154. A suitable conveyor belt 156 is positioned over the rollers to convey portions of the thermoplastic material which have been cut from the original article. An end roller of conveyor 146 is hydraulically powered by means of a suitable chain 158 transferring power from sprocket 160 of hydraulic motor 162 to sprocket 164 on the upper most conveyor roller. Suitable hydraulic connections 166 and 168 are provided on hydraulic motor 162 to communicate with hydraulic lines as described in the schematic view of FIG. 7.

To raise and lower conveyor 146 a hydraulic motor 170 is positioned on a support frame 172 between upright frame members 90, and operates a winch 174 on which is wound a cable 176 passing around pulley 178 secured to frame 180 which is pivotally attached to extension 182 of conveyor 146. An end of cable 176 is secured to an eye member 184 on upper frame 112. Suitable hydraulic connections 186 and 187 provide means for the communication of the pressurized hydraulic fluid from the hydraulic lines to the motor 170 in either direction as desired.

Figure 6:
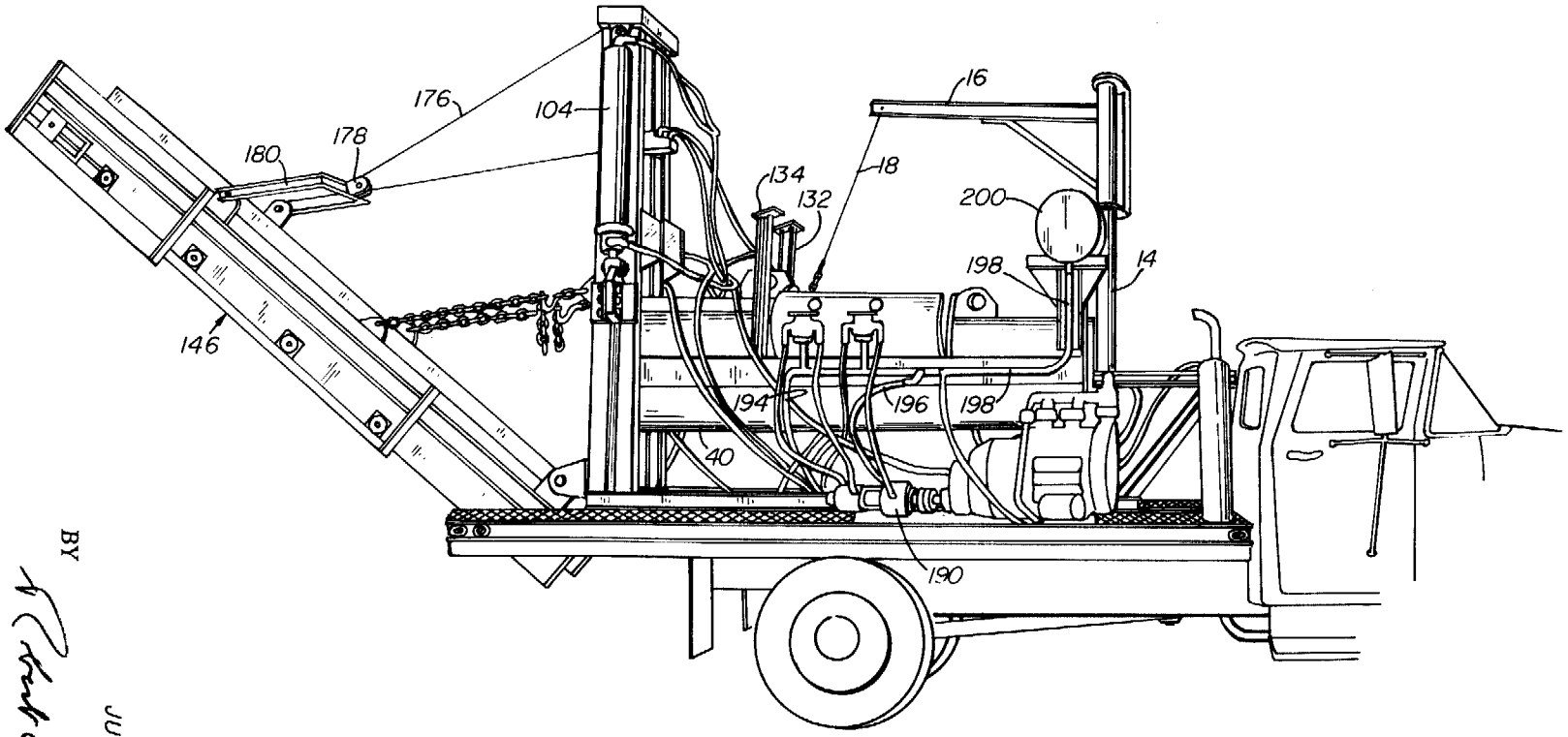
FIG. 6 is a perspective view, similar to FIG. 5, showing the opposite side of the cutter device components according to this invention.
Figure 7:
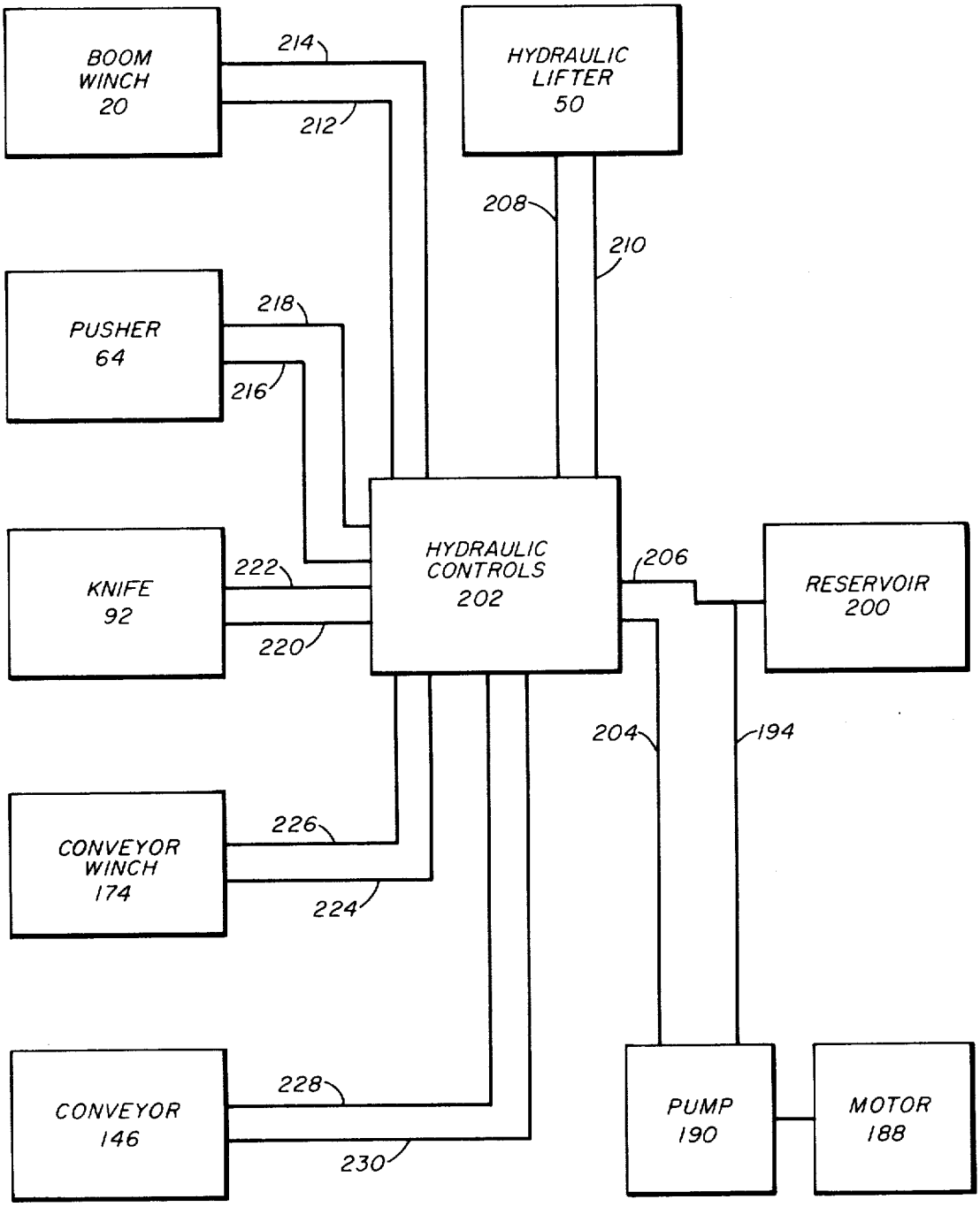
FIG. 7 is a schematic view of the hydraulic system of this invention.

As mentioned above, the hydraulic system is described schematically in FIG. 7. However, shown in FIG. 6 are the main components of the hydraulic system, a gasoline powered engine 188 providing power to operate hydraulic pump 190 which is connected by lines 194, 196, and 198 to hydraulic fluid reservoir 200. Other hydraulic lines and components are described in the schematic view of FIG. 7.

For the sake of simplicity the various hydraulic lines and their communications with the operating components and the hydraulic controls have been eliminated from the drawings of FIGS. 1, 2, 5, and 6, and are shown schematically in FIG. 7. FIG. 7 also shows schematically gasoline motor 188 and its connection to hydraulic pump 190 as well as the communication by return flow line 194 which may be a combination of return lines 194, 196, and 198 as shown in FIG. 6. All of the hydraulic components shown in this invention are double acting devices and therefore the hydraulic lines communicating with each component become alternately pressure lines and return flow lines. The control valves operating each component are conventional hydraulic valves and may be of any type, and may even be electronically operated from a central control panel. In FIG. 7 the controls are shown generically as hydraulic control system 202 with a pressurizabel hydraulic line 204 communicating with pump 190 and hydraulic control system 202 and a return flow line 206 from the hydraulic control system 202 communicating with line 194. Hydraulic lines 208 and 210 communicate between hydraulic control system 202 and hydraulic connections 58 and 60 on hydraulic lifter 50. Hydraulic lines 212 and 214 communicate between hydraulic control system 202 and hydraulic connections 24 and 26 of hydraulic motor 22 operating winch 20 Lines 216 and 218 communicate between hydraulic control system 202 and hydraulic connections 82 and 84 respectively of cylinder 66. Lines 220 and 222 communicate between hydraulic connections 119 and 120 respectively of cylinder 104 and hydraulic control system 202. It should be noted here that although only one hydraulic cylinder 104 is shown in the schematic FIG. 7, two hydraulic cylinders are shown in FIGS. 1 and 2, and similar connections can be made for each cylinder. Lines 224 and 226 communicate between hydraulic connections 186 and 187 of hydraulic motor 170 and hydraulic control system 202. Lines 228 and 230 communicate between hydraulic connections 166 and 168 respectively of hydraulic motor 162 operating conveyor 146 and hydraulic control system 202.

Since many different embodiments of this invention may be made without departing from the spirit and scope thereof, it is to be understood that the specific embodiments described in detail herein are not to be taken in a limiting sense, since the scope of the invention is best defined by the appended claims.

I claim:

1. A cutter device for cutting thermoplastic material, comprising:

a frame, including support means for portions of thermoplastic materials, pusher means for urging said portions of thermoplastic material toward a first end of said support means, an end plate on said support means, disposed substantially normal thereto, said end plate having a slot therein, a double acting knife blade slidable on said frame operable adjacent to and parallel to said end plate, said double acting knife blade having cutter means positioned thereon slidable in relation to said slot, power means to operate said pusher means and said knife blade, said power means being hydraulic means, and said hydraulic means including control means to operate said hydraulic means selectively, said pusher means including a hydraulic cylinder behind a reciprocable pusher member and in substantial axial alignment therewith to move said pusher member reciprocably, said frame including a hydraulically operable lift member positioned swingably adjacent said support means to receive said thermoplastic material and transfer said material to said support means, said frame including a swinging boom positioned upstandingly adjacent said support means and having hydraulically operable lifting means to lift articles of thermoplastic material and place them upon said lift member, said frame including a conveyor having a conveyor support frame attached pivotally by a first end to said frame adjacent said end plate, a cable having a first end attached to a second end of said support frame and second end attached to a hydraulically operated winch to raise and lower said conveyor, and a hydraulically operated conveyor belt, said conveyor positioned to receive cut portion of thermoplastic material and convey said portion to a remote location.

2. A cutter device as described in claim 1, wherein: said hydraulically operated winch and said hydraulically operated conveyor belt are hydraulically communicable with said hydraulic means of said cutter device.

* * * * *